US009464376B2

(12) United States Patent
Kim

(10) Patent No.: US 9,464,376 B2
(45) Date of Patent: Oct. 11, 2016

(54) WASHING MACHINE

(71) Applicant: Dongbu Daewoo Electronics Corporation, Seoul (KR)

(72) Inventor: Dae Hyun Kim, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 0 days.

(21) Appl. No.: 14/318,212

(22) Filed: Jun. 27, 2014

(65) Prior Publication Data

US 2015/0008808 A1 Jan. 8, 2015

(30) Foreign Application Priority Data

Jul. 4, 2013 (KR) ..... 10-2013-0078303

(51) Int. Cl.

| | |
|---|---|
| ***A47B 49/00*** | (2006.01) |
| ***A47B 77/06*** | (2006.01) |
| ***A47K 1/04*** | (2006.01) |
| ***E05C 17/64*** | (2006.01) |
| ***E05D 11/08*** | (2006.01) |
| ***D06F 17/00*** | (2006.01) |
| ***D06F 39/14*** | (2006.01) |
| *D06F 23/04* | (2006.01) |

(52) U.S. Cl.

CPC ..... *D06F 39/14* (2013.01); *D06F 23/04* (2013.01)

(58) Field of Classification Search

CPC ... D06F 39/14; D06F 37/28; Y10T 16/5357; Y10T 16/5358; Y10T 16/53613; Y10T 16/5367

USPC ..... 312/228, 326; 68/196, 3 R; 16/342, 303, 16/330

See application file for complete search history.

(56) References Cited

U.S. PATENT DOCUMENTS

| | | | | | |
|---|---|---|---|---|---|
| 2,003,274 | A | * | 5/1935 | Celander | 62/440 |
| 2,557,048 | A | * | 6/1951 | Haase | 220/830 |
| 3,392,820 | A | * | 7/1968 | Azim | 206/555 |
| 3,457,584 | A | * | 7/1969 | Phelps | 16/290 |
| 3,921,254 | A | * | 11/1975 | Foster et al. | 16/229 |
| 3,952,369 | A | * | 4/1976 | Erickson | 16/265 |
| 4,787,121 | A | * | 11/1988 | Racenis et al. | 16/356 |
| 4,914,781 | A | * | 4/1990 | Sokn et al. | 16/225 |

(Continued)

FOREIGN PATENT DOCUMENTS

| | | | |
|---|---|---|---|
| CN | 101984180 | A | 3/2011 |
| KR | 10-2009-0071272 | A | 7/2009 |
| KR | 20110013150 | A | 2/2011 |

OTHER PUBLICATIONS

Kim, Chang Hoo; Washing Machine With a Detergent Feeding Unit in Order to Make the Detergent Evenly Spread Within a Washing Tub; Korean Patent Abstracts, Publication No. 1020090071272 A; Publication date: Jul. 1, 2009; Korean Intellectual Property Office, http://kpa.kipris.or.kr/.

(Continued)

*Primary Examiner* — Daniel J Troy
*Assistant Examiner* — Kimberley S Wright

(57) ABSTRACT

A washing machine including an attachment groove on or in a top portion or surface of a cabinet; a joint member coupled to the cabinet and in the attachment groove; a door configured to open and close an inlet of the cabinet, and a damper connected to the joint member and configured to adjust or control a rotational speed of the door.

7 Claims, 9 Drawing Sheets

(56) References Cited

U.S. PATENT DOCUMENTS

| | | | | |
|---|---|---|---|---|
| 5,109,571 | A * | 5/1992 | Ohshima et al. | 16/307 |
| 5,437,168 | A * | 8/1995 | Mason et al. | 68/3 R |
| 5,943,739 | A * | 8/1999 | Vandergriff | 16/366 |
| 6,564,428 | B2 * | 5/2003 | Richard et al. | 16/366 |
| 6,766,596 | B1 * | 7/2004 | Bienick et al. | 34/601 |
| 6,857,538 | B2 * | 2/2005 | Lin | 220/830 |
| 7,032,350 | B2 * | 4/2006 | Bienick et al. | 49/501 |
| 7,090,095 | B2 * | 8/2006 | Schafer | 220/826 |
| 7,239,504 | B2 * | 7/2007 | Schlesener et al. | 361/679.09 |
| 7,661,176 | B2 * | 2/2010 | Hsu et al. | 16/342 |
| 7,980,644 | B2 * | 7/2011 | Kim et al. | 312/405.1 |
| 8,141,206 | B2 * | 3/2012 | Chen et al. | 16/342 |
| 8,245,353 | B2 * | 8/2012 | Homner et al. | 16/299 |
| 8,752,248 | B2 * | 6/2014 | Nakasone | 16/342 |
| 8,936,330 | B2 * | 1/2015 | Kim et al. | 312/298 |
| 9,080,365 | B2 * | 7/2015 | Collene et al. | |
| 2001/0044988 | A1 * | 11/2001 | Buscella | 16/412 |
| 2005/0103796 | A1 | 5/2005 | Schafer | |
| 2006/0254323 | A1 * | 11/2006 | Kim | 68/235 R |
| 2009/0070962 | A1 * | 3/2009 | Su | 16/360 |
| 2009/0205168 | A1 * | 8/2009 | Guo et al. | 16/308 |
| 2009/0229313 | A1 * | 9/2009 | Yoo et al. | 68/12.26 |
| 2011/0016640 | A1 * | 1/2011 | Kim et al. | 8/137 |
| 2011/0018408 | A1 * | 1/2011 | Cho et al. | 312/228 |
| 2011/0050060 | A1 * | 3/2011 | Kim et al. | 312/228 |
| 2011/0062837 | A1 * | 3/2011 | Kim et al. | 312/228 |
| 2011/0062839 | A1 * | 3/2011 | Kim et al. | 312/228 |
| 2011/0089793 | A1 * | 4/2011 | Kim et al. | 312/228 |
| 2011/0121694 | A1 * | 5/2011 | Kim et al. | 312/204 |
| 2012/0144750 | A1 * | 6/2012 | Sartor | 49/399 |
| 2012/0187811 | A1 * | 7/2012 | Kim et al. | 312/228 |
| 2012/0192380 | A1 * | 8/2012 | Huang et al. | 16/319 |
| 2012/0279261 | A1 * | 11/2012 | Ka et al. | 68/12.04 |
| 2014/0116097 | A1 * | 5/2014 | Park et al. | 68/196 |
| 2014/0150212 | A1 * | 6/2014 | Collene et al. | 16/286 |
| 2014/0262420 | A1 * | 9/2014 | Scanzillo et al. | 174/67 |

OTHER PUBLICATIONS

Chinese Office Action dated Dec. 4, 2015 issued in corresponding Chinese Patent Application No. 201410315694.8 and English translation thereof.

* cited by examiner

WASHING MACHINE

CROSS-REFERENCE RELATED APPLICATIONS

This application is based on and claims priority to Korean Patent Application No. 10-2013-0078303, filed on Jul. 4, 2013, the disclosure of which is incorporated herein in its entirety by reference.

FIELD OF THE INVENTION

The present invention relates to a washing machine, and, more particularly, to a washing machine capable of reducing a risk of accident and/or of increasing a user's safety by suppressing a free fall of a door on the washing machine, and also capable of shortening the working time for repair and maintenance of the door by allowing easy installation and separation or removal of the door.

BACKGROUND OF THE INVENTION

In general, a washing machine includes a cabinet having an inlet or opening through which laundry is put into or taken out of the washing machine, a cover at a top side or front of the cabinet to open and close the inlet, a tub within the cabinet, for accommodating water therein, and a drum within the tub. Some washing machines may have a pulsator configured to generate a flow of the water in the tub.

The cabinet is equipped with a rotatable door, and the inlet of the washing machine is opened or closed by the door.

This washing machine is configured to wash laundry through washing, rinsing and water-extracting operations to thereby eliminate dirt or contaminants on clothes, bedclothes, and the like.

Such a washing machine is described in Korean Patent Laid-open Publication No. 2009-0071272 (entitled "Washing Machine with Detergent Supply Apparatus," published on Jul. 1, 2009).

In such a washing machine, however, if the inlet of the washing machine faces upward, noise may be generated due to a free fall of the door which opens or closes the inlet of the washing machine. Furthermore, a user's hand or head might be caught between the door and the cabinet or case, causing an accident and endangering the user's safety.

Moreover, since a relatively large number of components are used for the installation, removal or separation of the door to or from the cabinet, the working time for repair and maintenance of the door be unacceptably large, which needs to be improved.

SUMMARY OF THE INVENTION

In view of the foregoing problems, the present disclosure provides a washing machine capable of preventing an accident and/or increasing a user's safety by suppressing the free fall of a door on the washing machine.

Further, the present disclosure also provides a washing machine capable of reducing the working time for repair and maintenance by allowing easy installation and separation or removal of the door.

However, the problems sought to be solved by the present disclosure are not limited to the above description, and other problems can be clearly understood by those skilled in the art to be solved or solvable from the following description.

In accordance with embodiments of the present invention, a washing machine may comprise an attachment groove on or in a top portion or surface of a cabinet, a joint member coupled to the cabinet and in the attachment groove, a door configured to open and close an inlet of the cabinet, and a damper connected to the joint member and configured to adjust, control and/or reduce a rotational speed of the door.

In embodiments of the present invention, the attachment groove comprises a base facing a bottom of the joint member, and/or a coupling protrusion protruding or extending from the base and in the joint member.

In embodiments of the present invention, the attachment groove comprises an inner sidewall facing a sidewall of the joint member, and one or more attachment ribs protruding or extending from the inner sidewall toward the joint member and configured to confine lateral movement of the joint member.

In embodiments of the present invention, the joint member comprises a head or head member connected to the damper, a body or body member extending from the head (member) and in the attachment groove, and a hook or hook member extending from the body (member) and on the base of the attachment groove. In some embodiment, the hook passes through a hole or opening in the base of the attachment groove.

In embodiments of the present invention, the joint member further comprises one or more protrusion ribs protruding or extending outward from the body member and in contact with the attachment rib(s).

In embodiments of the present invention, the attachment rib(s) and the protrusion rib(s) have (e.g., are configured or arranged in) mutually intersecting directions.

In embodiments of the present invention, the damper comprises a damper rod in the joint member, and a damper body inside the door, configured to control a rotational speed of the damper rod. The damper body may be fastened to an inside surface of the door.

In the washing machine according to exemplary embodiments of the present disclosure, since the damper inside the door reduces a speed of the door (e.g., during a free fall), it may be possible to reduce or eliminate vibrations, damage and/or noise from the falling door, and also to prevent an accident to the user, thereby increasing the user's safety.

Further, according to exemplary embodiments of the present disclosure, since the door and the damper are manufactured as a single module and then coupled to the cabinet, installation and separation or removal of the door may be performed readily. Thus, the working time for repair and maintenance thereof may be shortened or decreased.

BRIEF DESCRIPTION OF THE DRAWINGS

The above and other objects and features of the present invention will become apparent from the following description of various embodiments given in conjunction with the accompanying drawings, in which.

DETAILED DESCRIPTION

Figure 1:
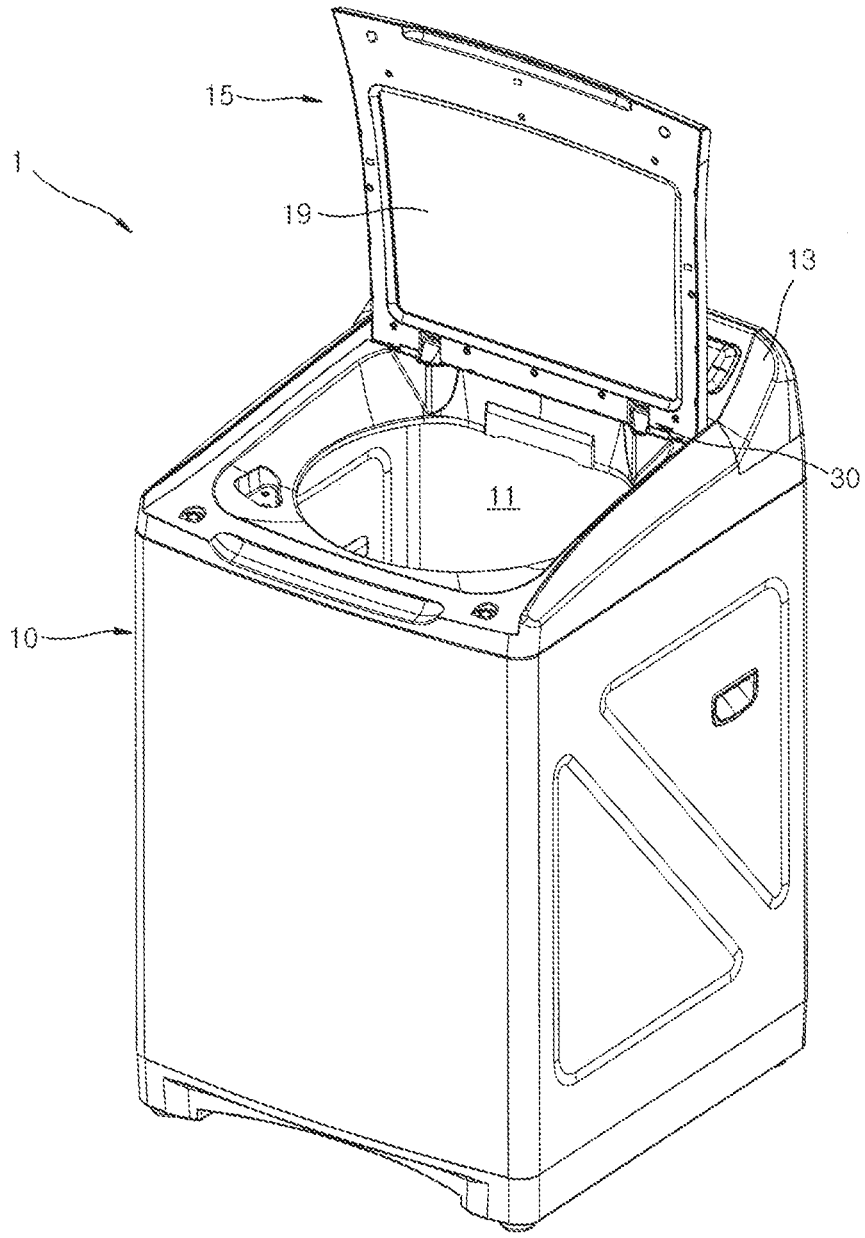
FIG. 1 is a perspective view schematically illustrating an exemplary washing machine in accordance with one or more embodiments of the present disclosure.

Hereinafter, one or more exemplary embodiments of a washing machine in accordance with the present disclosure will be elaborated with reference to accompanying drawings, which form a part of the description. Here, it is noted that the drawings are schematic and are not necessarily dimensionally illustrated. Relative sizes and proportions of parts in the drawings may be exaggerated or reduced in their sizes, and a predetermined size is just exemplary and not limiting. Further, the terms used in this document are defined in consideration of their functions in the exemplary embodiments of the present disclosure, and their definitions may differ depending on intentions of users or operators or practices. Thus, the definitions of the terms used in this specification should be understood based on the entire disclosure of this document.

Figure 2:
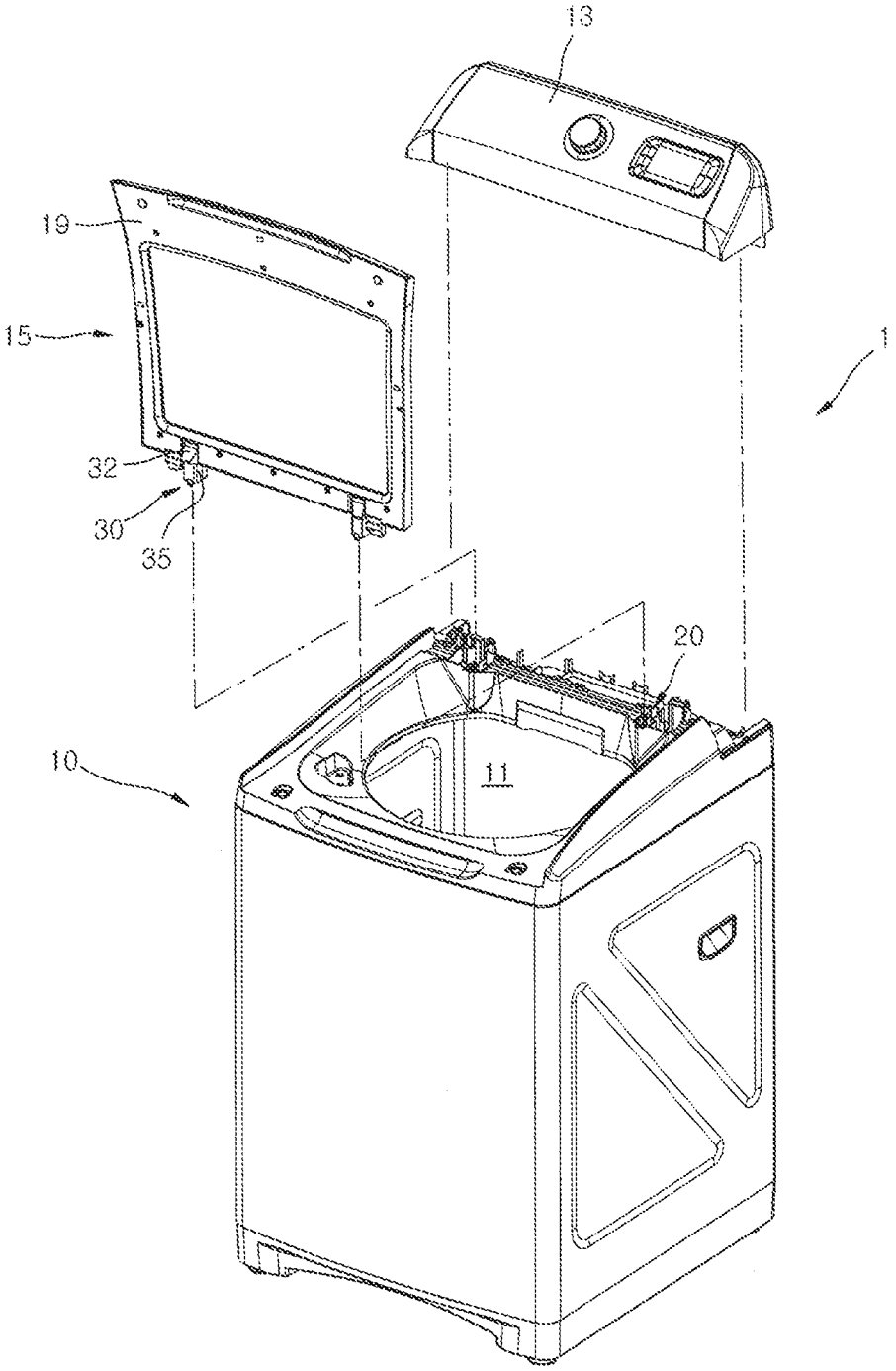
FIG. 2 is a perspective view illustrating an exploded view of an exemplary control panel and an exemplary door in accordance with embodiment(s) of the present disclosure.
Figure 3:
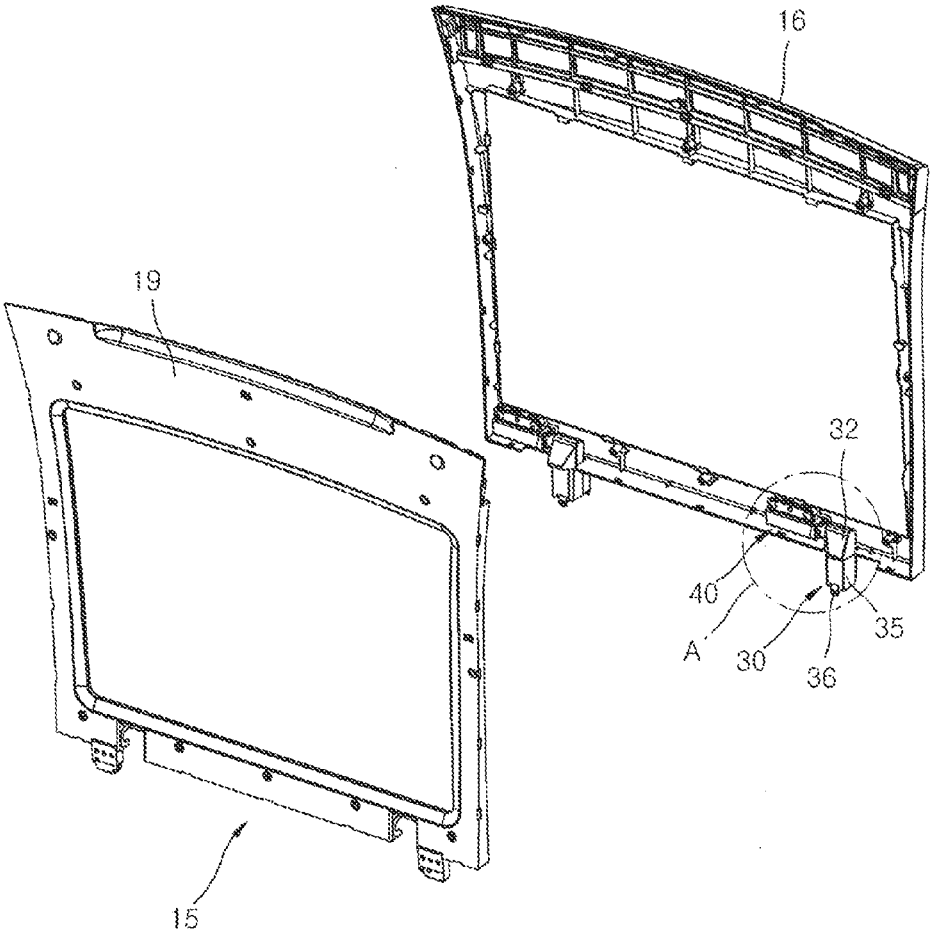
FIG. 3 is an exploded perspective view of the exemplary door in accordance with embodiment(s) of the present disclosure.
Figure 4:
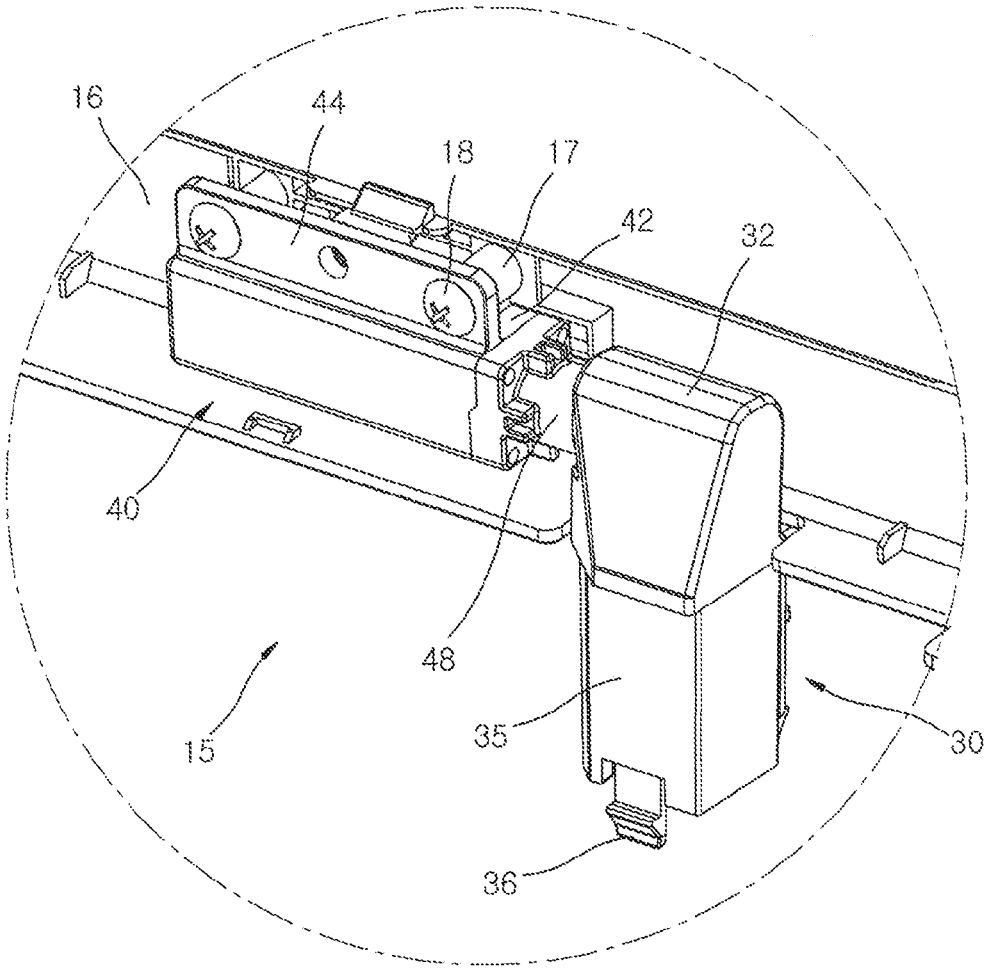
FIG. 4 is an enlarged perspective illustrating the area A of FIG. 3.
Figure 5:
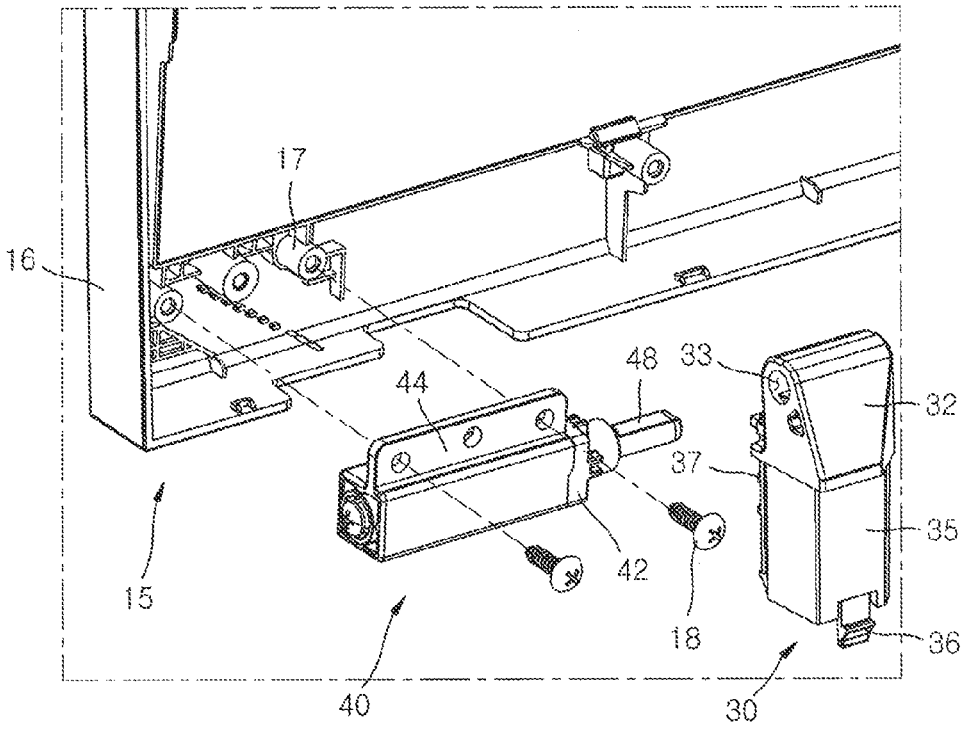
FIG. 5 is an exploded perspective view schematically illustrating an exemplary damper separated from the door and an exemplary joint member in accordance with embodiment(s) of the present disclosure.
Figure 6:
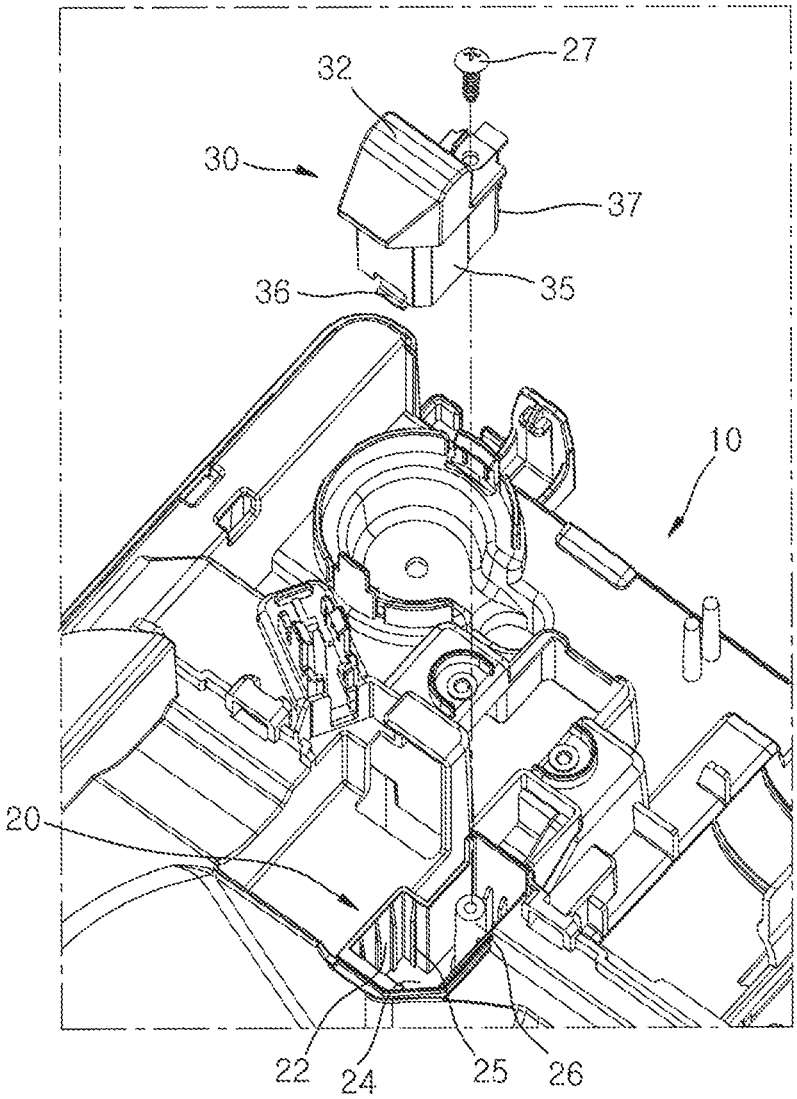
FIG. 6 is a perspective view illustrating the exemplary joint member separated from an exemplary attachment groove in accordance with embodiment(s) of the present disclosure.
Figure 7:
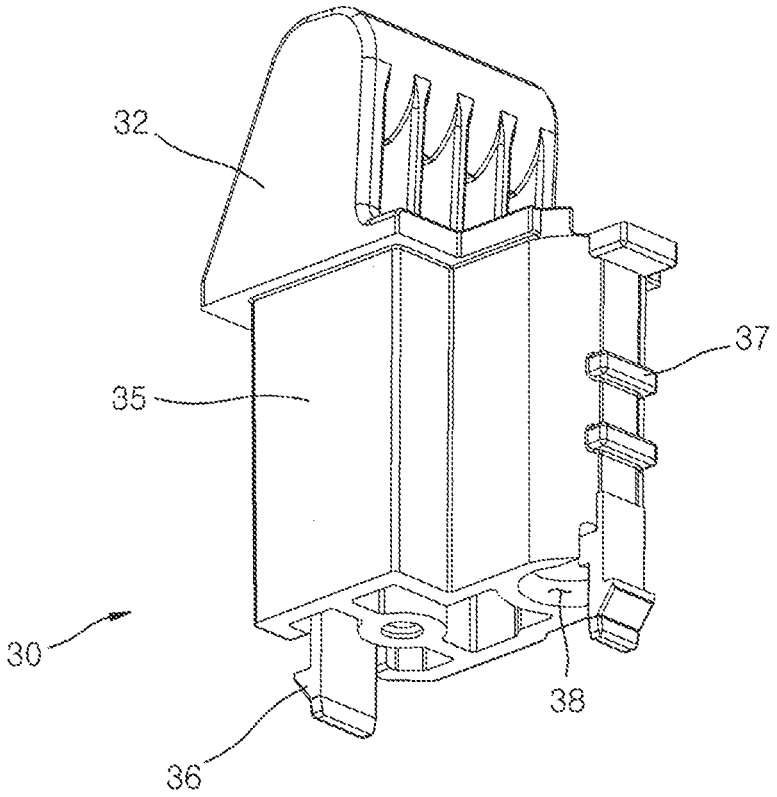
FIG. 7 is a perspective view illustrating the exemplary joint member in accordance with embodiment(s) of the present disclosure.
Figure 8:
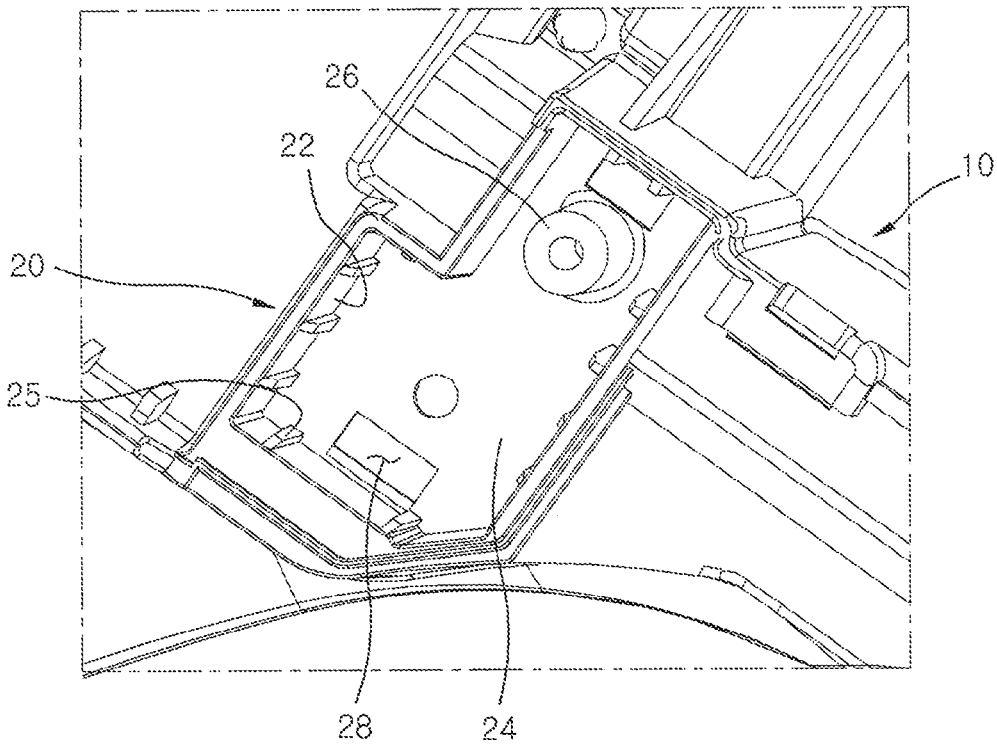
FIG. 8 is a perspective view illustrating the exemplary attachment groove in accordance with embodiment(s) of the present disclosure.

FIG. 1 is a perspective view schematically illustrating an exemplary washing machine in accordance with one or more embodiments of the present disclosure. FIG. 2 is an exploded perspective view schematically illustrating an exemplary door and control panel separated from an exemplary cabinet in accordance with embodiment(s) of the present disclosure. FIG. 3 is an exploded perspective view of the exemplary door in accordance with embodiment(s) of the present disclosure. FIG. 4 is an enlarged perspective view illustrating the area A of FIG. 3. FIG. 5 is an exploded perspective view schematically illustrating an exemplary damper separated from the door and an exemplary joint member in accordance with embodiment(s) of the present disclosure. FIG. 6 is a perspective view illustrating the exemplary joint member is separated from an exemplary attachment groove in accordance with embodiment(s) of the present disclosure. FIG. 7 is a perspective view illustrating the exemplary joint member in accordance with embodiment(s) of the present disclosure. FIG. 8 is a perspective view illustrating the exemplary attachment groove in accordance with embodiment(s) of the present disclosure.

As depicted in FIG. 1 to FIG. 3, a washing machine 1 in accordance with exemplary embodiment(s) of the present disclosure includes attachment grooves 20 in or on a top portion of a cabinet 10, joint members 30 for fastening the door 15 to the cabinet 10 by placement, mating or fitting into the attachment grooves 20, a door 15 configured to open and close an inlet 11 of the cabinet 10, and dampers 40 connected to the door 15 and the joint member 30 to control a rotational speed of the door 15. The attachment grooves 20 may also refer to wells, depressions, or openings in the cabinet 10 into which the joint members 30 are inserted. The term "groove" is intended to cover all variations of grooves, wells, depressions, or openings configured to receive a male fitting member.

The inlet 11 through which laundry is put into or taken out of the washing machine is at a top of the cabinet 10, which forms the exterior of the washing machine 1.

The attachment grooves 20 configured to receive the joint members 30 are at or in the top surface of the cabinet 10. Further, a control panel 13 for manipulating (e.g., controlling operations of) the washing machine 1 is also at the top or upper surface of the cabinet 10.

The door 15 is connected to the joint members 30, and rotates up and down, thus opening or closing the inlet 11 of the cabinet 10.

In accordance with one or more exemplary embodiments, the door 15 includes a front door 16 to which the dampers 40 are secured, and a rear door 19 coupled to the front door 16. The front door 16 may also refer to a front, top or outer surface of the door 15, and the rear door 19 may refer to a rear, bottom or inner surface of the door 15.

Here, the rear door 19 is positioned to face toward the inlet 11 of the cabinet 10, while the front door 16 faces toward the outside of the washing machine 1 when the door 15 closes the inlet 11 of the cabinet 10.

The dampers 40 are fastened to the inside of the door 15. Each damper 40 is rotatable and installed at a location corresponding to a unique one of the joint members 30.

As shown in FIG. 6 to FIG. 8, each attachment groove 20 configured to receive a corresponding one of the joint members 30 is at the top portion or surface of the cabinet 10. The attachment groove 20 is configured to be connected to or separated from the joint member 30 easily, or vice versa.

The attachment groove(s) 20 in accordance with exemplary embodiment(s) include an inner sidewall 22, a base 24, one or more attachment ribs 25, a coupling protrusion 26, and a hook insertion hole or opening 28.

In the attachment groove 20, the base 24 faces a bottom of the joint member 30, and the inner sidewall 22 faces a sidewall of the joint member 30.

The coupling protrusion 26 protruding or extending from and/or vertically extending from the base 24 is inserted into the joint member 30 and engages with a bolt or screw 27 through the joint member 30.

In the embodiment shown in FIGS. 6 and 8, a plurality of attachment ribs 25 protruding or extending from the inner sidewall 22 toward the joint member 30 are along the sidewall 22.

The attachment ribs 25 project or extend in a vertical direction (e.g., in length) along the inner wall 22, and extend in a horizontal direction (e.g., in height) into the cavity or opening in the attachment groove 20. The attachment ribs 25 contact the sidewall of the joint member 30 or protrusion ribs 37 protruding or extending outward from the sidewall of the joint member 30.

The attachment ribs 25 are configured to be in contact with the joint member 30 and confine the lateral movement of the joint member 30. When the joint member 30 is deformed, the shape of one or more of the attachment ribs 25 can be modified easily (e.g., in the factory or in the home) to secure the joint member 30. Thus, production costs may be reduced.

As depicted in FIG. 4, FIG. 5 and FIG. 7, the joint member 30 includes ahead member (or head) 32, a body member (or body) 35, a hook member (or hook) 36, the protrusion ribs 37, and a coupling hole or opening 38.

The head member 32 has a connection hole or opening 33 configured to receive a damper rod 48 of the damper 40 therein. The connection hole or opening 33 has dimensions about the same as or slightly greater than the damper rod 48, and may have small ribs, rings or protrusions on an inner surface thereof that are configured to secure the damper rod 48 tightly in the connection hole or opening 33. Alternatively, the ribs, rings or protrusions in the connection hole or opening 33 may allow the damper rod 48 to rotate in the connection hole or opening 33. The head member 32 may be located or inserted inside the door 15.

The damper rod 48 may have a rectangular cross-sectional shape, but other cross-sectional shapes, such as square, circular, oval, hexagonal, etc. may be suitable. Accordingly, the connection hole or opening 33 into which the damper rod 48 is placed or inserted may also have a rectangular or other shape complementary to that of the damper rod 48.

The body member 35 extending from the head member 32 and placed or inserted into the attachment groove 20 may be integral (e.g., formed as one single piece or unit, for example by injection molding or stamping) with the head member 32.

The hook member 36 extending downward from the body member 35 hooks or latches onto the base 24 when inserted into the hook insertion hole or opening 28 in the base 24. There may be a plurality of (e.g., 2) hooks extending from the body member 35 (e.g., on opposed sides or surfaces of the body member 35).

The protrusion ribs 37 protrude or extend outward from the body member 35, and my contact one or more of the attachment ribs 25 on a sidewall of the attachment groove 20. The protrusion ribs 37 may suppress or inhibit the joint member 30 from tilting (e.g., to the rear) and/or may hold the body member 35 more securely in the attachment groove 20.

Figure 9:
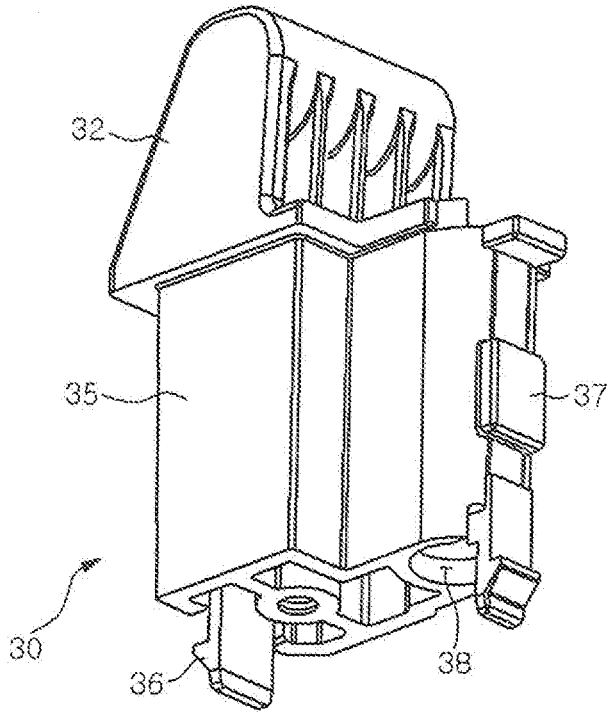
FIG. 9 is a perspective view illustrating the exemplary joint member in accordance with embodiment(s) of the present disclosure.

In the example shown in FIGS. 6-7, the attachment ribs 25 and the protrusion ribs 37 are aligned in intersecting directions (i.e., one is horizontally aligned, and the other is vertically aligned). Thus, the attachment ribs 25 and the protrusion ribs 37 are generally always in contact with each other. Alternatively, with reference to FIG. 9, the attachment ribs 25 and the protrusion ribs 37 may be aligned in parallel, in which case an attachment rib 25 can slide between and/or mate with two protrusion ribs 37, or vice versa (e.g., a protrusion rib 37 can slide between and/or mate with two attachment ribs 25). In such a case, either the attachment ribs 25 or the protrusion ribs 37 can have a height and/or slope that enables a contact point or surface with the complementary object (i.e., the body 35 or the attachment groove 20) and thus enable the body 35 to fit securely in the attachment groove 20.

In accordance with exemplary embodiment(s), the protrusion ribs 37 project or extend in a horizontal direction, whereas the attachment ribs 25 project or extend in the vertical direction. Of course, other arrangements or alignments of the ribs are possible. Thus, the protrusion ribs 37 and the attachment ribs 25 may intersect each other orthogonally.

Multiple attachment ribs 25 are along the inner sidewall 22 of the attachment groove 20 facing the body member 35. In some embodiments, two or more attachment ribs 25 are along opposed inner sidewalls 22 in the attachment groove 20, and in further embodiments, two or more attachment ribs 25 are along at least two pairs of opposed inner sidewalls 22 in the attachment groove 20. The protrusion ribs 37 that contact the attachment ribs 25 may be on the rear side of the body member 35 (i.e. facing the back of the washing machine 1), thus preventing the body member 35 from tilting to the rear. However, one or more (e.g., a plurality of protrusion ribs 37 may be on one or more other (e.g., an opposite) sides of the body 35.

The coupling hole or opening 38 receives the coupling protrusion 26 therein, and is at a bottom portion or in a bottom surface of the joint member 30. The bolt or screw 27 is inserted through the body member 35 from above (e.g., through an upper side or surface of the body member 35, toward a lower side thereof) and engages with the coupling protrusion 26.

As shown in FIG. 3 to FIG. 5, the damper 40 is connected to both the joint member 30 and the door 15. Any one of various damping devices may be utilized, as long as it can adjust or dampen (e.g., reduce) a rotational speed of the door 15. As shown in FIG. 3, a plurality of dampers 40 may be attached to the inner surface of the door 15.

In accordance with exemplary embodiment(s), the damper 40 includes the damper rod 48, and a damper body 42 that is fastened or affixed to the inside of the door 15 and configured to control a rotational speed of the damper rod 48.

A flange 44 extending from or surrounding the exterior of the damper body 42 contacts fastening bosses 17 on an inner surface of the door 15 (e.g., on or at the inside of the front door 16), and fastening bolts or screws 18 are screwed into the fastening bosses 17 through the flange 44.

The dampers 40 are respectively provided at two opposite sides of the door 15 (e.g., left and right, when facing the front panel of the washing machine). The damper rod 48 of each damper 40 is inserted into the connection hole or opening 33 of the joint member 30, and rotation of the damper rod 48 is generally confined or inhibited by the connection hole or opening 33 (e.g., one or more structures on the inner surface of the connection hole or opening 33, and/or one or more structures on the outer surface of the damper rod 48).

The damper rod 48, when in the connection hole 33, may not rotate. Instead, in such a case, the damper body 42 rotates along with the door 15.

In this configuration, since the rotational speed of the door 15 is varied and/or controlled by the dampers 40, it may be possible to suppress or inhibit safety problems, damage to the washing machine, and noise that might be caused by a free fall of the door 15.

Further, since the same joint members 30 and the same cabinet 10 can be used in washing machine models that do not include the dampers 40 as well as models that include the dampers 40, it may be possible to reduce production costs and/or manage inventory of parts efficiently.

Now, an operation of the washing machine 1 in accordance with exemplary embodiments of the present disclosure will be explained with reference to the accompanying drawings.

With the damper rod 48 of each damper 40 inserted into the connection hole or opening 33 of a corresponding one of the joint members 30, the dampers 40 are fastened or fixed to the fastening bosses 17 of or on the door 15.

The front door 16 and the rear door 19 may be coupled to each other with the damper 40 therebetween. In such embodiments, the door 15, the damper 40 and the joint member 30 may exist as a single module or unit.

The joint member 30 is inserted or fitted into the attachment groove 20, and the hook(s) 36 are inserted into the hook insertion hole(s) or opening(s) 28 in the base 24 and latched, locked and/or secured on or to the attachment groove 20 (e.g. a bottom side of the base 24).

The coupling protrusion 26 of the attachment groove 20 is inserted into the coupling hole or opening 38 in the joint member 30, and the bolt or screw 27 is screwed into the coupling protrusion 26 through the joint member 30, thus more securely fastening the joint member 30 to the attachment groove 20. In some embodiments, less than all of the disclosed mechanisms that secure the joint member 30 in the attachment groove 20 are employed (e.g., one or two of the hook[s] 36, the bolt or screw 27, and the protrusion ribs 37 and attachment ribs 25).

Removal of the door 15 from the cabinet 10 is performed in the reverse order as that described above to assemble or attach the door 15 to the cabinet 10. Under some conditions, the same door 15 and the same joint member 30 can be used with the dampers 40 or without the dampers 40, thereby possibly reducing production costs and/or part inventory management complexity.

With the configuration as described above, in the washing machine 1 according to exemplary embodiments, since the speed of a freely falling door 15 is reduced by the dampers 40 inside the door 15, it may be possible to suppress or reduce noise and vibration, damage to the washing machine 1, and/or safety problems due to the falling door 15.

In addition, since the door 15, the damper 40 and the joint member 30 can be manufactured as a single module and then coupled to the cabinet 10, installation and separation of the door 15 may be performed easily and/or readily. As a consequence, the working time for repair and maintenance of the door and/or the washing machine may be shortened.

Although exemplary embodiments of the present disclosure are described above with reference to the accompanying drawings, those skilled in the art will understand that the present disclosure may be implemented in various ways without changing the necessary features or the spirit of the present disclosure. Therefore, it should be understood that the exemplary embodiments described above are not limiting, but only an example in all respects. The scope of the present disclosure is expressed by claims below, not the detailed description, and should be construed that all changes and modifications achieved from the meanings and scope of claims and equivalent concepts are included in the scope of the present disclosure.

Further, in the above description of exemplary embodiments, a pulsator type washing machine has been illustrated. However, the example embodiments of the present disclosure are not limited thereto and may also be applicable to various other types of lashing machines such as a drum type washing machine.

Accordingly, it should be understood that the true scope and spirit of the present disclosure is indicated by the following claims.

What is claimed is:

1. A washing machine, comprising:

an attachment groove on a top portion or surface of a cabinet;

a joint member in the attachment groove;

a door coupled to the joint member and configured to open and close an inlet of the cabinet; and a damper connected to the joint member and configured to control a rotational speed of the door, wherein the damper comprises:

a damper rod in the joint member;

a damper body coupled to the door and configured to control rotational speed of the damper rod, the damper rod also in the damper body; and a flange coupled to the damper body, wherein the flange contacts fastening bosses on an inner surface of the door, and fastening bolts or screws are screwed into the fastening bosses through the flange to couple the damper body to the door;

wherein the door and the damper are manufactured as a single module that is coupled to the cabinet;

wherein the joint member comprises:

a head member connected to the damper;

a body member extending from the head member and into the attachment groove; and a hook extending from the body member that hooks, latches or is secured onto the base of the attachment groove;

wherein the attachment groove comprises:

an inner sidewall facing a sidewall of the joint member; and one or more attachment ribs protruding or extending from the inner sidewall toward the joint member, and configured to confine lateral movement of the joint member;

wherein the joint member further comprises one or more protrusion ribs protruding or extending outward from the body member and in direct physical contact with the one or more attachment ribs; and wherein the one or more attachment ribs and the one or more protrusion ribs are aligned in directions parallel to one another, and wherein the one or more attachment ribs are mated with the one or more protrusion ribs.

2. The washing machine of claim 1, wherein the attachment groove comprises:

a base facing a bottom of the joint member.

3. The washing machine of claim 2, wherein the attachment groove further comprises:

a coupling protrusion protruding or extending from the base and in the joint member.

4. The washing machine of claim 1, wherein the attachment groove further comprises a plurality of attachment ribs on each of at least two opposing inner sidewalls of the attachment groove.

5. The washing machine of claim 1, wherein the hook passes through a hole or opening in the base of the attachment groove.

6. The washing machine of claim 1, wherein the damper body is fastened to the inner surface of the door.

7. The washing machine of claim 1, wherein the damper rod is inserted into an opening of the joint member, and wherein the damper rod, when in the opening, is not rotatable and the damper body rotates with the door to control rotational speed of the door.

* * * * *